US008201601B2

(12) United States Patent
Van Valkenburg

(10) Patent No.: US 8,201,601 B2
(45) Date of Patent: Jun. 19, 2012

(54) SYSTEM AND DEVICE FOR HOLDING A WORK PIECE TO BE MACHINED BY A ROUTER AND USE THEREOF

(76) Inventor: Sjoerd Anne Van Valkenburg, The Hague (NL)

( * ) Notice: Subject to any disclaimer, the term of this patent is extended or adjusted under 35 U.S.C. 154(b) by 173 days.

(21) Appl. No.: 12/497,863

(22) Filed: Jul. 6, 2009

(65) Prior Publication Data

US 2010/0000631 A1 Jan. 7, 2010

Related U.S. Application Data

(60) Provisional application No. 61/078,508, filed on Jul. 7, 2008.

(51) Int. Cl.
*B27M 1/00* (2006.01)

(52) U.S. Cl. ..... 144/371; 144/144.1; 144/253.1

(58) Field of Classification Search ..... 144/144.1, 144/144.51, 145.1, 286.1–287, 371, 372, 144/253.1, 253.6

See application file for complete search history.

(56) References Cited

U.S. PATENT DOCUMENTS

| | | | | |
|---|---|---|---|---|
| 5,117,880 | A * | 6/1992 | Kapton et al. | 144/251.1 |
| 5,325,899 | A * | 7/1994 | Kochling | 144/144.1 |
| 7,240,704 | B1 * | 7/2007 | Vice | 144/144.1 |
| 7,360,567 | B2 * | 4/2008 | Gregoire | 144/253.1 |
| 7,819,145 | B1 * | 10/2010 | Vice | 144/144.1 |

* cited by examiner

*Primary Examiner* — Shelley Self
(74) *Attorney, Agent, or Firm* — Sand & Sebolt

(57) ABSTRACT

A system for machining a work piece. The system includes a router device for routing out a part of the work piece with a router bit and a holding device for holding the work piece while being routed. The router device includes a first reference element and a second reference element positioned substantially perpendicular to the first reference element, both reference elements being arranged so as to guide the holding device in a lateral direction during machining of the work piece. The holding includes a clamping arrangement and a guiding arrangement. The guiding arrangement includes a first guiding element and a second guiding element substantially perpendicular to the first guiding element for guiding the holding device along the first guidance reference and the second reference element. The clamping arrangement is arranged for clamping the work piece with a clamping force being exercised substantially in the lateral direction.

42 Claims, 9 Drawing Sheets

SYSTEM AND DEVICE FOR HOLDING A WORK PIECE TO BE MACHINED BY A ROUTER AND USE THEREOF

FIELD

The present invention relates to a system and device for holding a work piece to be machined by a router. The invention also relates to the use of a system and device for holding the work piece to be machined.

BACKGROUND

A router is a tool, especially used in the woodworking industry, used for milling out (hollow out) an area in the face of a piece of material (work piece). Usually the material is wood or metal, but applying the router to other types of materials is also possible. There are several types of routers. Nowadays, most common types are spindle type routers (spindle routers), where a router bit is mounted onto a rotatable spindle of an electric motor.

A typical router set-up includes a frame for supporting the router table. The piece of material to be machined is supported by the router table. The router table has an opening through which a bit protrudes for machining the material. Different bit sizes and shapes can be used, and the bit is easily exchangeable. The bit is engaged by a collet provided with a clamping mechanism such as a number of clamps or jaws. The collet is part of a rotatable spindle that is connected to a motor drive for rotation. The router collet (and router bit mounted in the mouth of the collet) can be rotated around an axis perpendicular to the router table. Sometimes the collet may be able to move with respect to the router table, for example, along the axis of rotation by a depth adjustment tool. In this case, the shape of the cut that is created is determined by the size and shape of the bit (cutter) held in the collet and the height of the bit relative to the work piece. The bit may machine a work piece from the bottom of the piece by positioning the work piece over the opening in the router table and the bit to e.g. form a shaped groove or a shaped recess in the work piece. The bit may machine the work piece from a side by positioning the work piece adjacent to the opening in the router table with the router bit acting on the side of the work piece, to e.g. form a tapered side, or to form a groove in the side of the work piece.

A typical router system also includes a router fence. The router fence is placed on top of the table and is used as a stop along which the work piece can be guided during the machining thereof to ensure that proper parts of the work piece are cut away. The router fence is used as a directional tool during the processing of the work piece.

End grain wood, being the narrower side (the end) of a board, is difficult to guide along (and square to) the router fence of the router table without a considerable risk of it being pulled into the router bit which may damage the work piece and/or which may cause a hazardous situation. This is in contrast to guiding the long grain side of a board that can slide easily along the router fence, without a serious risk of it being pulled into the router bit.

In order to provide an improved guidance and to reduce the risk of being pulled into the router bit, the concept of a holding device, also referred to as coping sled or coping jig, used for routing the short end of a work piece (usually the end grain) has been developed in the woodworking industry. To hold the work piece firmly, but in such manner that it can still be moved parallel to the router fence for its edge forming, is a challenge that existing coping sleds have attempted to solve by mounting the clamping devices on a carrier board, exercising downward pressure. This carrier board effectively increases the height of the router table, so that it has to pass underneath the router bit. Consequently the router and/or the router bit have to be mounted higher to compensate for the thickness of the carrier plate.

Furthermore, this arrangement prevents the use of coping sleds vertically, as described above, because they do not have their own fence for keeping the coping sled safely positioned, and the carrier plate cannot ride behind the router bit in this position, as the carrier plate will be in between the router bit and the work piece. This is particularly prejudicial if a particular router bit set-up should not be disturbed between horizontal and vertical operations.

A further drawback of coping sleds using a carrier plate is the risk of deformation of that carrier plate, notably bending up, if more than a minimal clamping force is used to secure the work piece, compromising the integrity of the routing operation.

SUMMARY

An object of the present invention is to provide an improved device and system for holding a work piece for machining with a router, especially for a routing operation on an end grain of the work piece, and in particular for machining the end grain of an elongated work piece.

It is another object of the present invention to provide an improved method for holding a work piece for machining with a router, especially for a routing operation on an end grain of the work piece, and in particular for machining the end grain of an elongated work piece.

Embodiments of the present invention provide a device and system wherein at least one of the disadvantages of the prior art has been reduced or even removed.

Embodiments of the present invention provide a system and device wherein the holding and positioning of a work piece with regard to a router bit can be accomplished fast, accurately and/or easily, especially when the work piece is to be routed subsequently in a horizontal position and in a vertical position.

Embodiments of the present invention provide a simple process for machining a piece of material, more specifically a piece of wood, subsequently in a horizontal position and in a vertical position.

The present invention, in part, relates in a first aspect to a system for holding a work piece, the system comprising:

- a router device arranged and constructed for routing out a part of the work piece with a router bit,
- a holding device arranged and constructed to hold the work piece while being routed,
- the router device comprising a first reference element for providing a first guidance reference and a second reference element positioned substantially perpendicular to the first reference element for providing a second guidance reference, both reference elements being arranged so as to guide the holding device in a lateral direction during machining of the work piece,
- the holding device comprising a clamping arrangement and a guiding arrangement,
- the guiding arrangement comprising a first guiding element and a second guiding element substantially perpendicular to the first guiding element for guiding the holding device along the first guidance reference and the second reference element, and the clamping arrangement being arranged for clamping the work piece with a clamping force being exercised substantially in the lateral direction.

According to another aspect, the present invention relates to a holding device as such for holding a work piece for being routed using a router device with a router bit, the router device comprising a first reference element for providing a first guidance reference and a second reference element positioned substantially perpendicular to the first reference element for providing a second guidance reference, the reference elements being arranged so as to guide the holding device in a lateral direction during machining of the work piece, The holding device according to the invention comprises a clamping arrangement and a guiding arrangement, the guiding arrangement comprising a first guiding element and a second guiding element substantially perpendicular to the first guiding element for guiding the holding device along the first guidance reference and the second reference element, and the clamping arrangement being arranged for clamping the work piece with a clamping force being exercised substantially in the lateral direction.

The first reference element may be a router table for supporting the work piece. The second first reference element may be a router fence. The first guiding element may be a base plate of the holding device. The second guiding element may be a fence plate of the holding device.

The first guiding element may be arranged for guiding the holding device along the first guidance reference, while the second guiding element is arranged for guiding the holding device along the second guidance reference. Alternatively, the first guiding element may be arranged for guiding the holding device along the second guidance reference, while the second guiding element is arranged for guiding the holding device along the first guidance reference.

With the clamping force being exercised substantially in the lateral direction, there may be substantially no forces perpendicular to the work piece nor to the holding device, thus ensuring absence of unwanted stress or strain in unwanted directions in the work piece which could otherwise deform the work piece, while preventing the work piece from being pulled into the router bit during routing. Deformation of the work piece may cause routing a shape which deviates from the intended shape, which is, at least largely, prevented when using the holding device according to the embodiment of the invention.

In further embodiments, the guiding arrangement is substantially free of the clamping force. Forces exercised on the guiding arrangement could otherwise deform the guiding arrangement. Deformation the guiding arrangement may have the risk of deforming the work piece and/or changing the position of the work piece relative to one, or both, guidance references, which may cause routing a deviating shape or routing at a slightly dislocated position. The holding device according to the further embodiments of the invention advantageously prevent such deformation, may thus ensure a proper guiding.

In an embodiment, the clamping arrangement is further arranged for positioning the work piece substantially in line with at least one of the first guiding element and the second guiding element.

E.g., when the first guiding element is arranged for guiding the holding device along the first guidance reference, the work piece may be positioned in line with the first guiding element, e.g. preceding the first guiding element while being guided along the first guidance reference.

In such an arrangement, none of the guiding elements can obstruct the clamping arrangement, thus allowing an unobstructed access to the part of the work piece that needs to be machined.

In an embodiment, the clamping arrangement is detachably connected to the guiding arrangement.

The clamping arrangement and the guiding arrangement thus form separate parts, which are connected during machining. This may allow an easy disassemble and assembly. This may allow assembling a differently sized clamping arrangement when a work piece is too large to be fitted by the clamping arrangement that is connected to the guiding arrangement. Alternatively or additionally, this may allow replacing the guiding arrangement with an alternative guiding arrangement for machining the work piece in another orientation.

Alternatively or additionally, this may allow easy placing of the work piece in the clamping arrangement while the clamping arrangement is disconnected and is more easy to handle than when it is connected to the guiding arrangement.

In another embodiment, the clamping arrangement and the guiding arrangement are an integrally formed part.

Such integrally formed part may be advantageous for cost reasons, and may e.g. be used for a low-end, low-cost market segment.

In an embodiment, the clamping arrangement comprises a first clamping element and a second clamping element arranged for receiving the work piece between the first clamping element and the second clamping element and for clamping the work piece between first clamping element and the second clamping element.

The first clamping element may be a vise plate and the second clamping element may be a vise clamp plate, the vise plate and the vise clamp plate forming a vise with facing vise surfaces for clamping the work piece. The vise plate and the vise clamp plate may comprise non-slip treatments at the vise surfaces holding the work piece.

Such clamping arrangement allows to firmly hold the work piece, while also maintaining free access to surfaces of the work piece to be machined, in particular to the surface at the side of the router table and the end surface at the side of the router fence.

In a further embodiment, the clamping arrangement is arranged to further hold an auxiliary piece between the first clamping element and the second clamping element, the auxiliary piece having substantially the same width as a width of the work piece.

This forms a structure with a high structural integrity while introducing no or only little strain and deformation in the guiding arrangement of the holding device. In a further embodiment the auxiliary piece is positioned close to one edge of the clamping elements of the clamping arrangement, while the work piece is positioned close to a second, opposite edge of the clamping elements. The structure may e.g. form a substantially rectangular box. This may further reduce the risk of stress to occur in the holding device, which may have a positive influence on the accuracy than can be reached in the routing operation.

In a further embodiment, the clamping force is substantially evenly distributed over the work piece and the auxiliary piece during holding the work piece and the auxiliary piece.

This may result in a further improved integrity of the structure and may further limit strain and deformation in the work piece.

E.g. for achieving such evenly distribution of the clamping force, in an embodiment, the clamping force is applied to positions on the first clamping element and the second clamping element in between the work piece and the auxiliary piece.

In an embodiment wherein the clamping arrangement is arranged for cooperating with an external clamp providing at least part of the clamping force between the first clamping element and the second clamping element.

The external clamp may e.g. be a hand clamp. Such an external clamp may be easily attached to and detached from the clamping arrangement for introducing and removing the work piece.

In another embodiment, the clamping arrangement further comprises a orientation device between the first clamping element and the second clamping element, the reference device being arranged for maintaining a relative orientation between the first clamping element and the second clamping element.

The orientation device allows the second clamping element plate to move freely while staying parallel to the first clamping element, e.g. while loading the work piece.

The orientation device may e.g. comprise a pair of rigid rods, connected at one side to the vise clamp plate, e.g. threaded into the inside face of the second clamping element, and sliding into holes in the first clamping element.

In a further embodiment, the orientation device is further arranged for providing at least part of the clamping force between the first clamping element and the second clamping element.

The guiding device, such as the pair of rigid rods, may e.g. be threaded along substantially their whole length and a bolt may be screwed on the thread and tightened to firmly clamp the work piece, and optionally the auxiliary piece, between the clamping elements. When the orientation device provides the clamping force itself, no external clamp is needed.

In an embodiment, the holding device is arranged for, in a first condition, holding the work piece for machining the work piece in a first orientation wherein the first guidance element is guided along the first reference element and the second guidance element is guided along the second reference element, and, in a second condition, holding the work piece for machining the work piece in a second orientation wherein the first guidance element is guided along the second reference element and the second guidance element is guided along the first reference element.

The first condition and the second condition may be the same, thus allowing the work piece to be machined in the first and the second orientation while maintaining the work piece in the holding device when changing from machining with the first condition to machining with the second condition. The first and second conditions may particularly be the same when the router can be operated while moving the holding device in either of the two possible directions along the first reference element, e.g. the router fence. The first and second conditions may be the same when the holding device has substantially a mirror symmetry.

The first and second condition may be different, e.g. when the holding device is not symmetrically itself, using a disassembly of the holding device in the first condition and a reassembly in the second condition associated with a mirror image of the holding device in the first condition may change the holding device into its mirror image.

It is an advantage using such holding device that the same holding device may be used for machining the work piece from two orientations, e.g. for creating a mitered corner using a Lock Miter router bit.

In an embodiment, the guiding arrangement of the holding device in the first condition is substantially a mirror image of the guiding arrangement of the holding device in the second condition.

In an embodiment, the guiding arrangement is arranged for being disassembled from the first condition into parts and reassembled into the second condition from the parts.

In an embodiment, the clamping device is substantially a mirror image of itself.

In an embodiment, the guiding arrangement comprises a clearance for allowing an unobstructed machining of the work piece with the router bit.

In particular when the router is used for machining the work piece in a horizontal and a vertical orientation, the guiding arrangement thus allows to machine the work piece up to its edges without e.g. the router bit running into e.g. the holding device.

In an embodiment, the second guidance element comprises a fixation element for adjustably fixating the work piece in position in the holding device.

The fixation element may e.g. be a hold-down piece adjustably mounted onto the holding device. The hold-down piece may e.g. be mounted on a hold-down plate, serving as an intermediate connector for the fixation element.

The fixation element may be held in place by a clamping knob and a T-slot nut for being laterally and vertically adjustable, to ensure stability of the holding device against the reference elements, such as the router table fence, and avoiding tip-in by restricting the movement of the work piece or by securing the work piece in position.

In an embodiment, one of the first reference element and the second reference element is a router table for supporting the work piece, and the router further comprises a router collet positioned beneath the router table, the router collet constructed and arranged to engage the router bit extending through an opening in the router table for machining the work piece.

In an further embodiment, the other of the first reference element and the second reference element is a router fence and the router collet is further constructed and arranged for machining the work piece with the router bit through an opening in the router fence.

According to another aspect, the present invention relates to a method for routing a work piece using a router device comprising a first reference element for providing a first guidance reference and a second reference element positioned substantially perpendicular to the first reference element for providing a second guidance reference, the reference elements being arranged so as to guide the holding device in a lateral direction during machining of the work piece, the holding device comprising a clamping arrangement and a guiding arrangement, the guiding arrangement comprising a first guiding element and a second guiding element substantially perpendicular to the first guiding element for guiding the holding device along the first guidance reference and the second reference element, and the clamping arrangement being arranged for clamping the work piece with a clamping force being exercised substantially in the lateral direction.

In an embodiment, the method comprises:

clamping the work piece with the force being exercised substantially in the lateral direction in the clamping arrangement in the holding device, guiding the holding device holding the work piece along the first guidance reference and the second guiding reference, and machining the work piece while the holding device is guided.

In an embodiment, the method further comprises:

holding a auxiliary piece having a substantially same width as a width of the work piece in parallel to the work piece while clamping the work piece in the clamping arrangement.

In an embodiment, the method comprises, first, holding the work piece for machining the work piece in a first orientation, guiding the first guidance element along the first reference element and the second guidance element along the second reference element, while the holding device is in a first condition, and subsequently, holding the work piece for machining the work piece in a second orientation wherein the first guidance element is guided along the second reference element and the second guidance element is guided along the first reference element, while the holding device is in a second condition.

In an embodiment, the method comprises, after machining the work piece in the first orientation with the holding device in the first condition and before machining the work piece in the second orientation:

disassembling the holding device into parts, and reassembling the parts for forming the holding device in the second condition, wherein the guiding arrangement is substantially a mirror image of the guiding arrangement of the holding device in the first condition.

In an embodiment, the method comprises:

first, holding the work piece with the holding device for machining the work piece in a first orientation, guiding the first guidance element along the first reference element and the second guidance element along the second reference element, and subsequently, holding the work piece with a second holding device for machining the work piece in a second orientation wherein the first guidance element of the second holding device is guided along the second reference element and the second guidance element of the second holding device is guided along the first reference element, the second holding device being substantially a mirror image of the first holding device.

The present invention is particularly suited for setting up an improved device for machining an end part of the piece, but is not limited thereto. The system and device may be able to position the work piece with respect to the router bit at different positions, e.g. when the piece is relatively small and therefore difficult to handle on a router, the system and device may be helpful also for machining the bottom surface of the work piece from below.

The system according to the present invention may include a router, a router table, a router fence and the holding device as described herein. The holding device may be integrated with the system, but can also be a separate part. This allows the holding device to be stored easily.

The holding device can be mounted on the router table. It can be secured in place using a gauge track running across the router table. The holding device can have a gauge connector for engaging the track. The track may run parallel to the fence and to the process direction of the bit.

BRIEF DESCRIPTION OF THE DRAWINGS

Embodiments of the invention will now be described by way of example only, with reference to the accompanying drawings, wherein.

DETAILED DESCRIPTION

The following detailed description of embodiments of the present invention will be better understood when read in conjunction with the appended drawings wherein like references indicate similar elements.

Figure 1A:
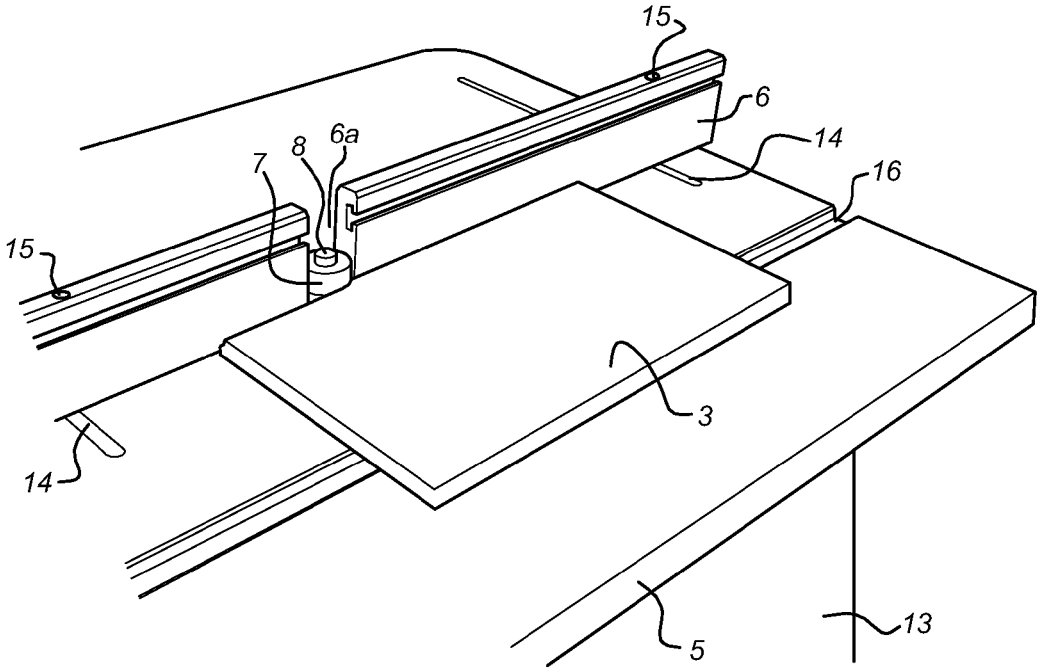
Fig 1a prior art
FIG. 1*a* and FIG. 1*b* show perspective views of a system with a work piece on a router table according to the prior art.
Figure 1B:
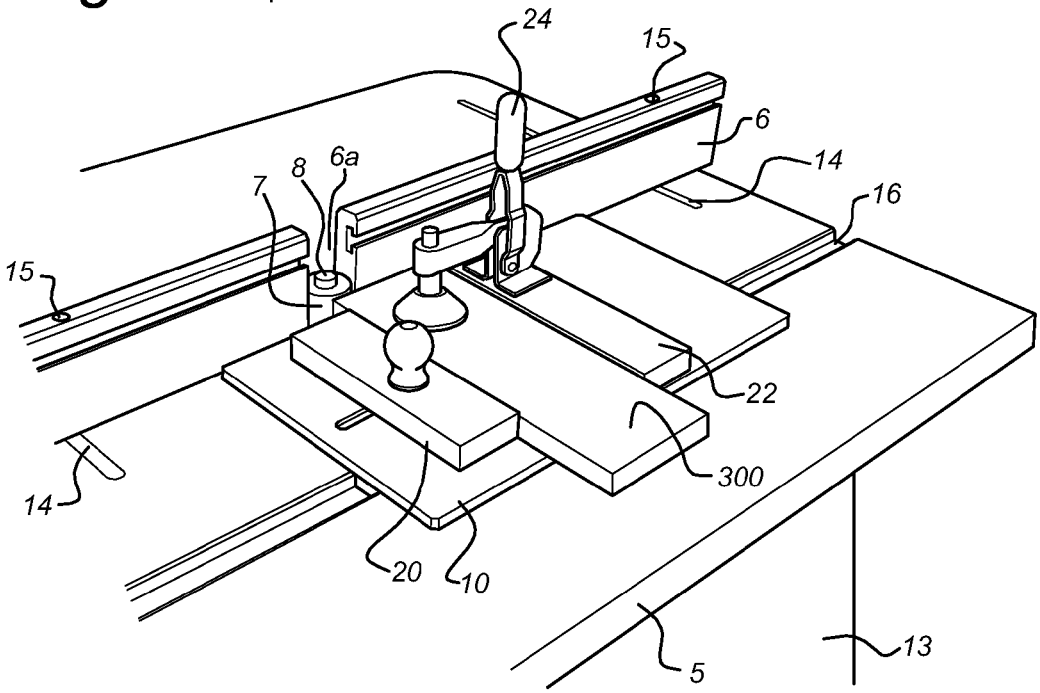
Fig 1b prior art

FIG. 1*a* and FIG. 1*b* shows a router 1 including a frame 13 and a first reference element, for instance a router table 5. The router table 5 is used to support a piece of material 3 (for example a piece of wood) to be machined, also referred to as a work piece. A plunge or fixed base router for routing out (hollow out) an area in the face of the piece of material 3 is arranged underneath the router table 5. The router includes a base, the base housing a vertically mounted electric motor with a router collet 7 on the end of its motor shaft. The router collet 7 is arranged to take up a router bit 8, which then extends through an opening in the router table 5. The router table further includes a second reference element, for instance a router fence or guiding fence 6, along which the piece of material 3 is to be guided during the routing out operation. The router table 5 and the router fence 6 determine a working direction and position of the groove to be machined in the piece of material 3. The router fence 6 is movable from back to front of the table along tracks 14 and may be secured to the router table 5 at any desired position. In order to secure the router fence to the router table 5, locking means 15 (schematically shown in FIG. 1) are provided. The router fence 6 is provided with a gap 6*a* or opening near the position of the router bit, the gap or opening leaving enough room for the work piece to move freely over or along the router bit 8.

When a long edge of a work piece 3 has to be machined, the work piece is positioned on the router table 5 with the long edge to the router fence 6, as shown in FIG. 1*a*. The work piece is then guided over the router table 5 and along the router fence 6 to the router bit 8 for machining the long edge, the router fence 6 guiding the work piece while the work piece is firmly held.

When a short edge of a work piece 300 has to be machined, holding the board firmly, but in such manner that it can still be moved parallel to the router fence for its edge forming, provides a challenge that existing holding devices have attempted to solve as shown in FIG. 1*b* by mounting a clamping device 24 on a carrier board 10 for exercising downward pressure on the work piece 300 thus holding the work piece 300 firmly on the carrier board 10. Stops 20 and 22 are provided on the carrier board 10 to keep the work piece 300 in position perpendicular to the router fence 6. The carrier board 10 is then guided over the router table 5 and along the router fence 6 to the router bit 8 for machining the short edge, or end part, of the work piece 300.

Figure 2:
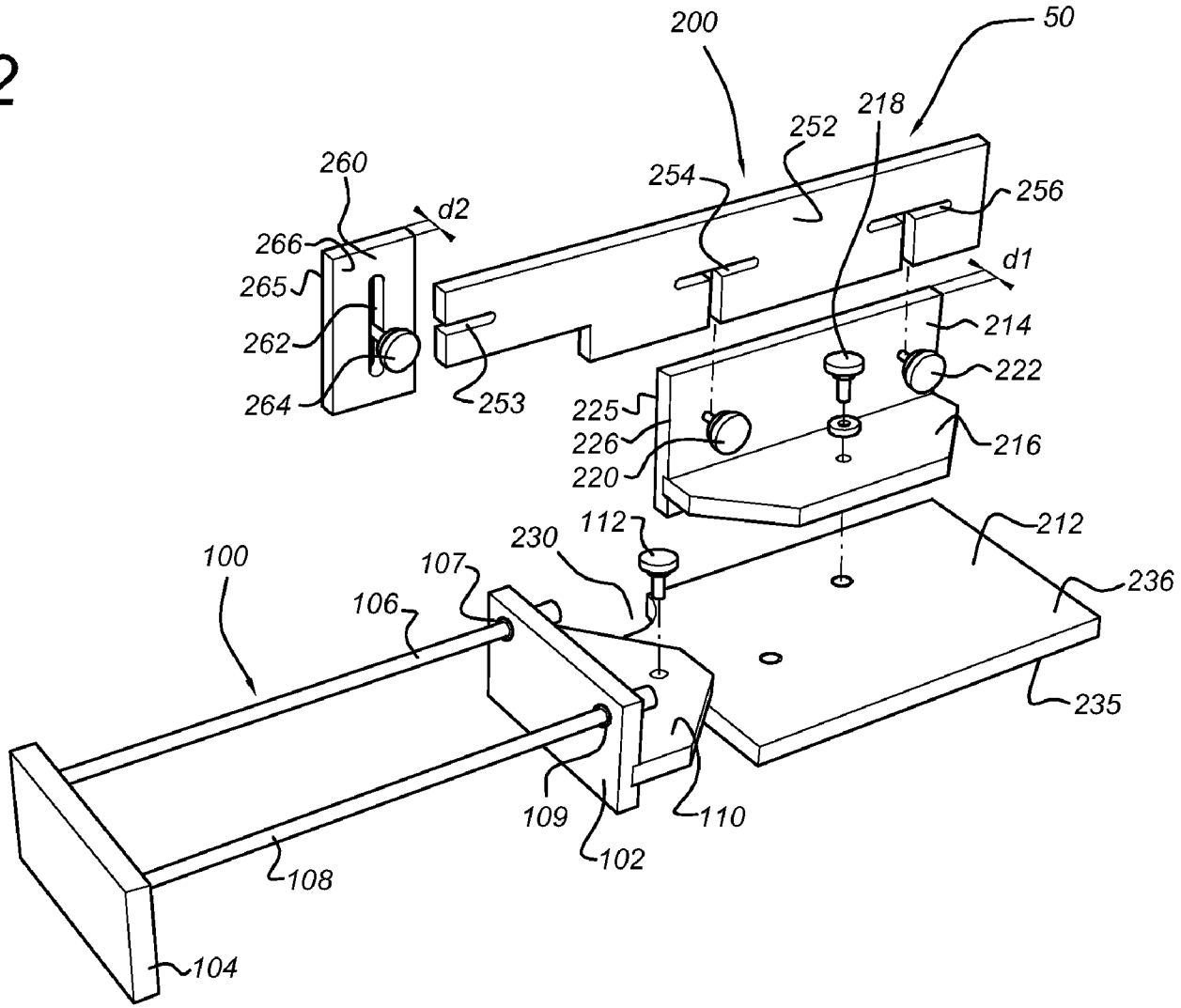
FIG. 2 shows a perspective view of parts of a holding device for holding a work piece in accordance with an embodiment of the present invention.
Figure 3:
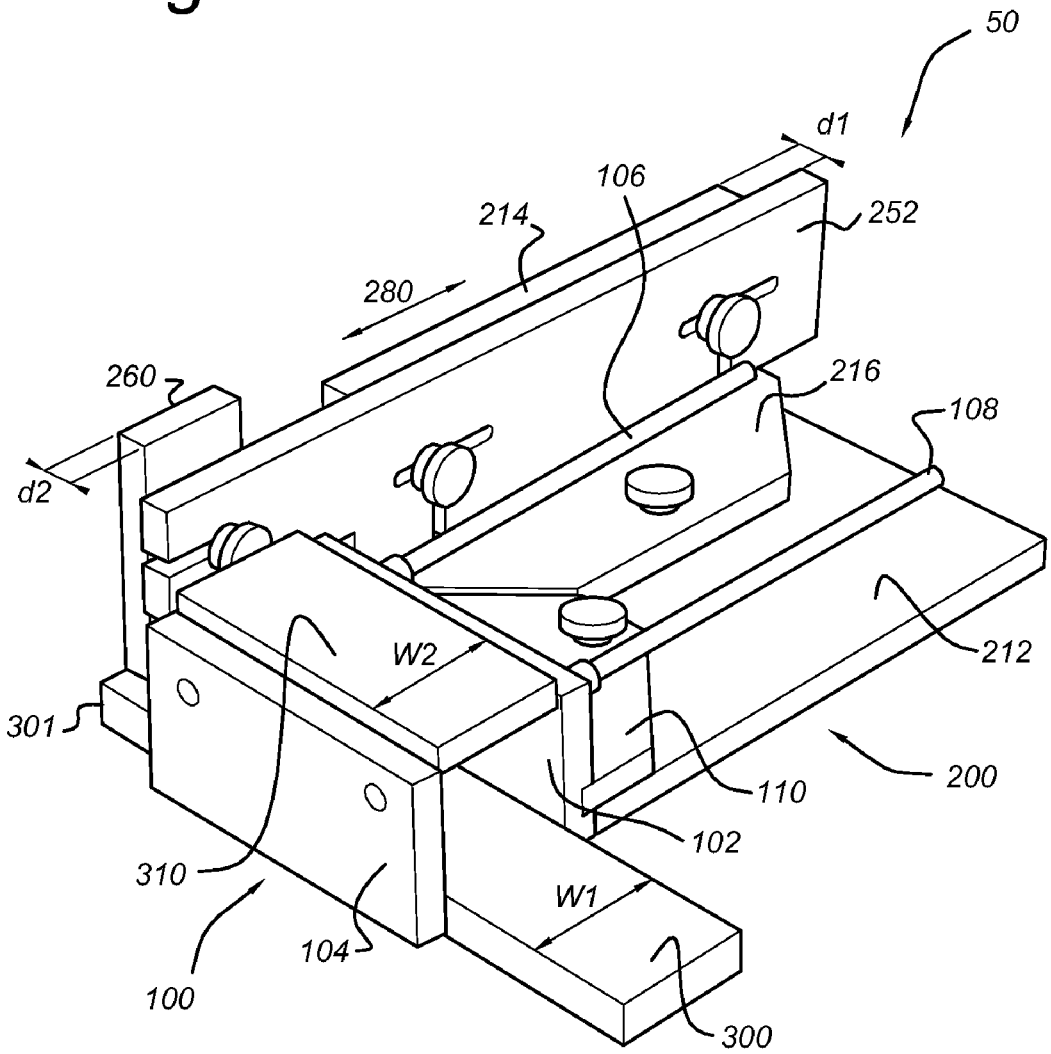
FIG. 3-FIG. 5 show perspective views of an assembled holding device for holding a work piece in accordance with an embodiment of the present invention.
Figure 4:
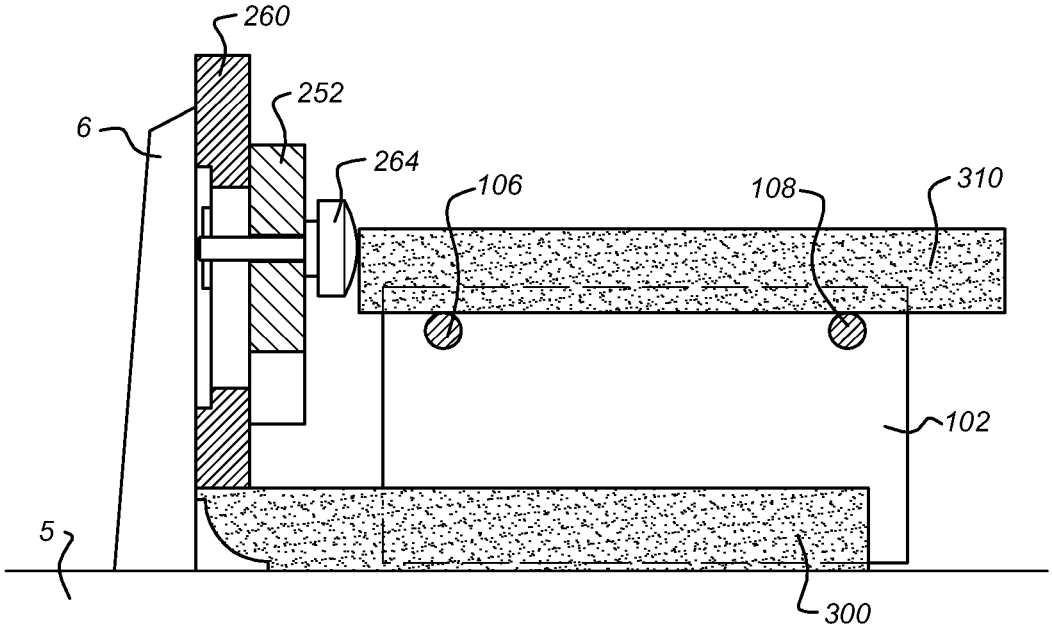
Figure 5:
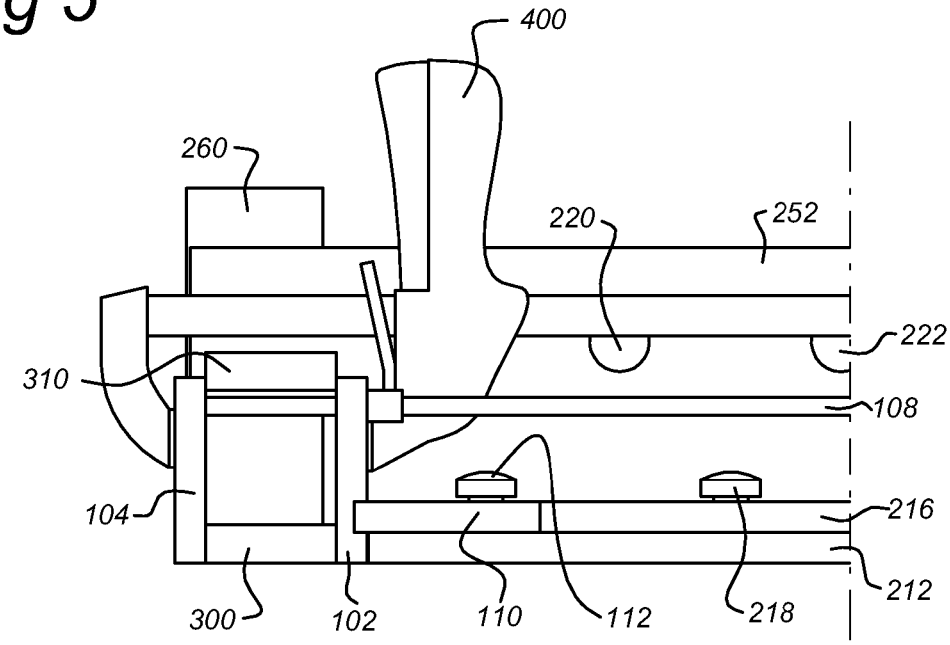

FIG. 2 shows a perspective view of parts of a holding device for holding a work piece in accordance with an embodiment of the present invention. FIG. 3-FIG. 5. show perspective views of an assembled holding device for holding a work piece in accordance with an embodiment of the present invention.

In the shown embodiment, a clamping arrangement 100 and a guiding arrangement 200 are connected to form a holding device 50.

In this exemplary embodiment, the clamping arrangement 100 and the guiding arrangement 200 are assembled from a plurality of parts shown in FIG. 2 and FIG. 3: a vise connector member 110, a vise plate 102, a vise clamp plate 104 and two steel rods 106, 108, a base plate 212, a fence 214, a fence plate 216, a hold-down plate 252, a hold-down end piece 260 and several clamping knobs and washers 112, 218, 220, 222, 264. In this and alternative embodiments, at least some parts may be releasably connected. In embodiments, at least some parts may be permanently connected or even integrated.

The parts of the holding device 50 may e.g. be made of melamine surfaced MDF, plywood or plastic (e.g. glass reinforced Nylon) parts, with steel rods, or extruded aluminium. The choice of materials used is not critical to the concept and operation, provided they are stable and ensure proper integrity of the parts and offer dimensional stability.

In this exemplary embodiment, assembly of the clamping arrangement 100 comprises threading the steel rods 106, 108 into the inside face of the vise clamp plate 104. With the vise clamp plate 104 attached, the steel rods 106, 108 slide into corresponding holes 107, 109 in the vise plate 102, allowing the vise clamp plate 104 to slide freely towards and away from the vise plate 102, while staying parallel to the vise plate 102. The vice connector member 110 is connected to the vise plate 102, and provides a connection to the guiding arrangement 200 with bolt 102 and a corresponding hole.

After assembly, the clamping arrangement 100 thus comprises a first clamping element in the form of the vise plate 102 and a second clamping element in the form of the vice clamp plate 104. The relative orientation between the two clamping elements is maintained by an orientation device in the form of the steel rods 106, 108.

In embodiments, the steel rods 106, 108 are each provided with a thread and corresponding bolts are provided for being threaded on the steel rods 106, 108 to exercise a clamping force in between the vise plate 102 and the vise clamp plate 104 for holding a work piece. The vise plate 102, the vise clamp plate 104, threaded steel rods 106, 108 and bolts thus form a vise for holding the work piece.

In embodiments, the vise plate 102 and the vise clamp plate 104 are arranged to receive and cooperate with an external clamp, such as a hand clamp, wherein the external clamp provides the clamping force in between the vise plate 102 and the vise clamp plate 104 for holding the work piece.

The hold-down plate 252 is slideably connected to the fence 214 using the two threaded clamping knobs 220, 220 and threaded inserts in the fence 214, the clamping knobs being movable in generally T-shaped slots 254, 256. The T-shaped slots are shaped for positioning the hold-down plate 252 relative to the fence 214. The hold-down end piece 260 is held in place by the clamping knob 264 and a corresponding nut, wherein the end piece can be displaced relative to the hold-down plate 252 by the presence of a slot 262 in the end-piece 260 and the slot in the fence 214. The hold-down end piece can be adjusted laterally and vertically, to ensure stability of the holding device against the router fence 6 and to hold down the work piece. Thickness d2 of the hold-down end piece 260 is the same as the thickness d1 of the fence 214, to provide a guiding interface e.g. for guidance along the router fence 6 with back surface 225 of the fence 214 and back surface 265 of the hold-down end piece 260 substantially in contact with the router fence 6.

After assembly, the guidance arrangement 200 thus comprises a first guiding element in the form of the base plate 212, a second guiding element comprising the fence 214 cooperating with the hold-down end piece 260, and a fixation element formed by the hold-down plate 252, the hold-down end piece 260 and the corresponding knobs 220, 222, 264 and slots 254, 256, 262.

The base plate 212 may comprise a clearance 230 serving as a space for the router bit 8 once it has completed its operation.

Assembly of the clamping arrangement 100 to the guidance arrangement 200 is performed by securing onto the base plate 212 both the vise connector member 110, connected to the vise plate 102, and the fence plate 216, with corresponding threaded knobs 112, 118.

Figure 6:
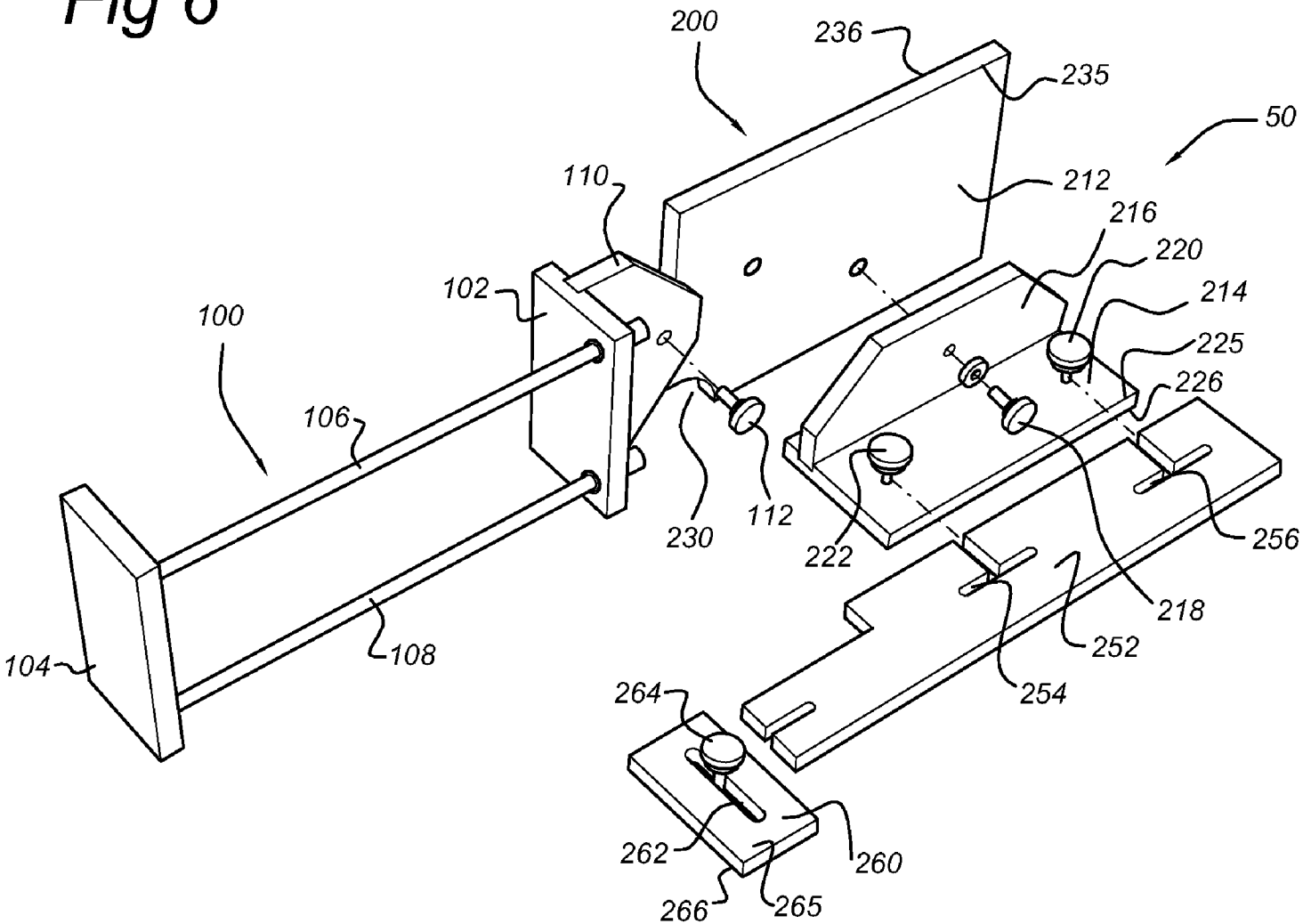
FIG. 6 shows a perspective view of parts of a holding device for holding a work piece in a second orientation in accordance with an embodiment of the present invention.
Figure 7:
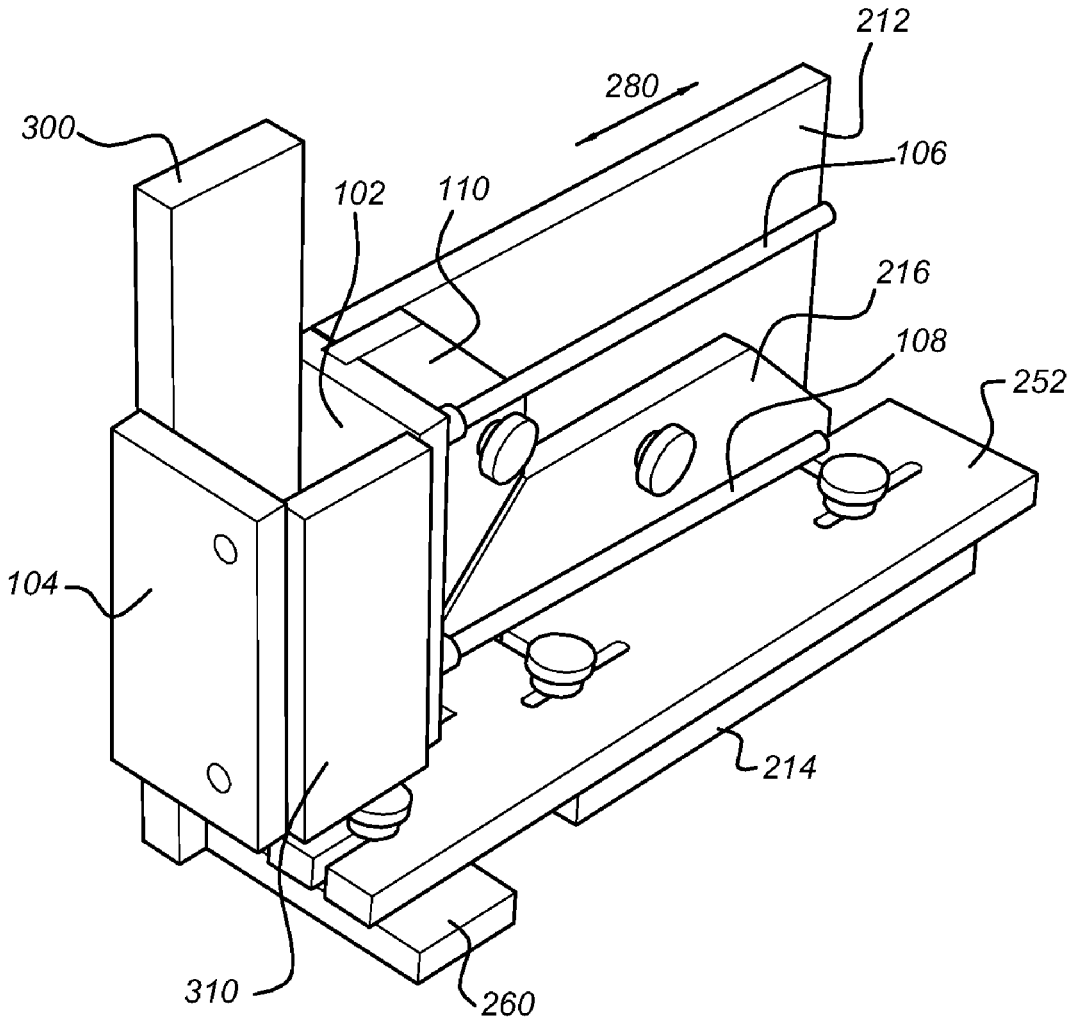
FIG. 7 shows a perspective view of an assembled holding device for holding a work piece in the second orientation in accordance with an embodiment of the present invention.

The layout of the holding device 50 can be inversed, as is shown in FIG. 6 and FIG. 7. The holding device 50 can be reassembled as a mirror image of itself, with the fence plate 216 and the vise plate 102 with the vise connection member 110 attached in reverse direction on the bottom side of the base plate 212. The hold-down plate 252 attaches in reverse direction, with the hold-down end piece 260 re-attached on the reverse side of the hold-down plate 252.

This inversion enabled by a situation of the holes and threads, respectively, of the two clamping knobs in the exact center of the corresponding sides of the base plate 212, while the hold-down plate's 252 attachment slots and the corresponding threaded holes in the fence 214 are symmetrically placed.

The holding device 50 can be operated both horizontally, in a first condition as is shown in FIG. 3-FIG. 5, with its base plate 212 riding on the router table 5 with surface 235, and vertically, in a second condition as is shown in FIG. 6-FIG. 7, with the base plate 212 pressed against the router fence 6 with surface 236.

For horizontal operation, the base plate 212 rests on the router table 5 with surface 235 and keeps the assembly in position, whereas the fence 214 together guides with its surface 225 along the router fence 6, as does the hold-down end piece 260 with its surface 265.

For vertical operation, the fence 214 rests on the router table 5 with surface 226 and keeps the assembly in position, together with the hold-down end piece 260 resting on the router table 5 with surface 266, whereas the base plate 212 guides with its surface 236 along the router fence 6.

As shown in FIG. 3 and FIG. 7, operating holding device 50 is done by introducing the work piece 300 between the vise plate 102 and the vise clamp plate 104 and securing the work piece 300 firmly in place using a clamping force in the lateral direction between the vise plate 102 and the vise clamp plate 104, e.g. using an external clamp such as a hand clamp 400 for providing the clamping force.

In order that the clamping force be exerted without deforming any part of the holding device 50 and/or of the work piece 300, while ensuring that the work piece 300 remains perpendicular to the router fence 6, an auxiliary piece 310 of identical width w2 as the width w1 of the work piece 300 may be placed on top of the steel rods 106, 108.

A substantially perfectly rectangular box is thus created and is held together with the hand clamp 400. The integrity of this rectangular box is ensured by distributing the clamping force substantially evenly by applying the hand clamp 400 providing the clamping force in between the work piece 300 and the auxiliary piece 310.

The rectangular box may have the effect of keeping the work piece securely in place, optionally aided by a non-slip treatment of the inside surfaces of the vise plate 102 and vise clamp plate 104. It may further reduce or even avoid any clamping strain on the holding device 50 itself. Therefore the rectangular box ensures the integrity of the routing operation.

Figure 8:
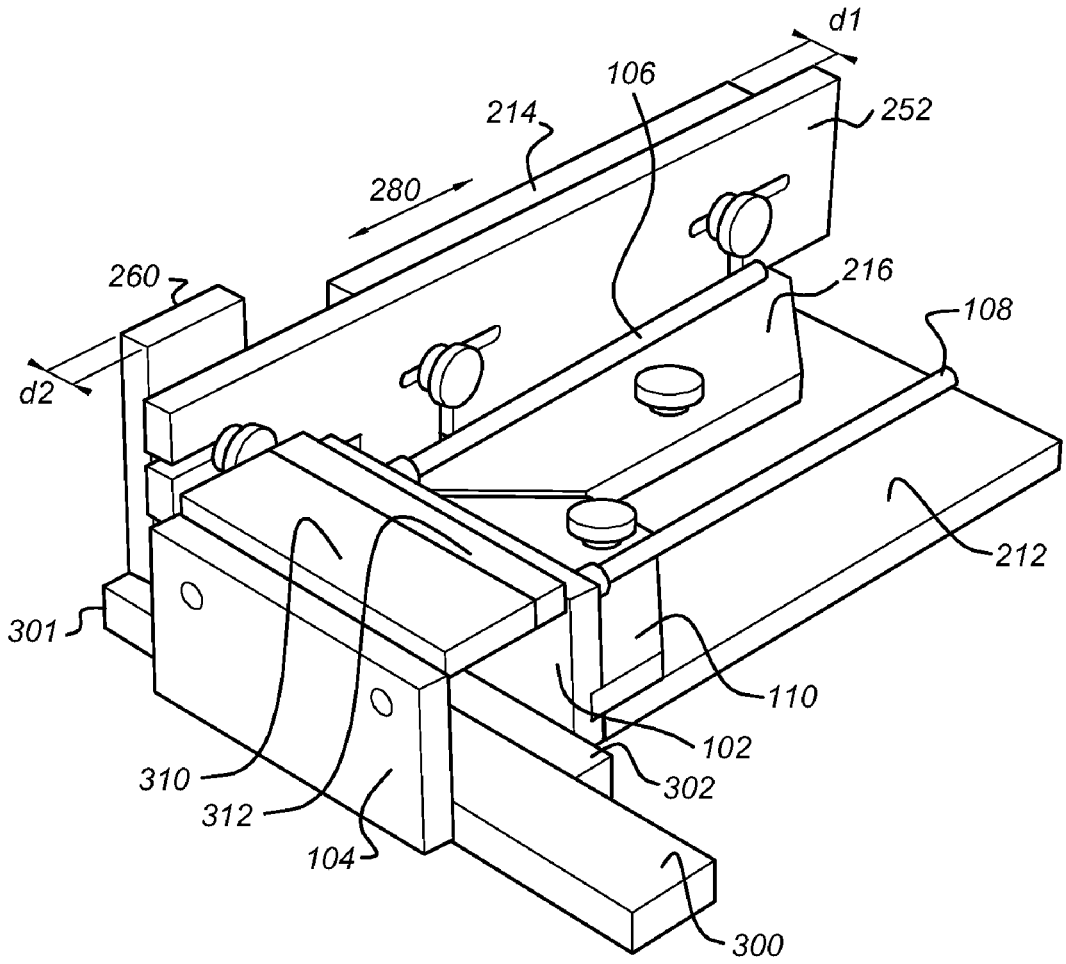
FIG. 8 shows a perspective view of a holding device using a backer board and an auxiliary backer board.

In order to avoid tear-out where the router bit 8 exits the work piece 300 when routing end grain, a sacrificial backer board 302 may be placed behind the work piece 300, i.e. in between the work piece 300 and the vise plate 102, as shown in FIG. 8. The backer board 302 may be a piece of scrap wood of the same thickness of the work piece 300 to be routed. In such operation, the backer board 302 may be duplicated by a auxiliary backer board 312 of identical width in pair with the auxiliary piece 310 for again obtaining a substantially perfectly rectangular box of work piece 300 with backer board 302, auxiliary In FIGS. 9-11 a further embodiment of the present invention is shown. In this embodiment again a clamping arrangement 401 and a guiding arrangement 500 are connected to form a holding device 150.

Figure 9:
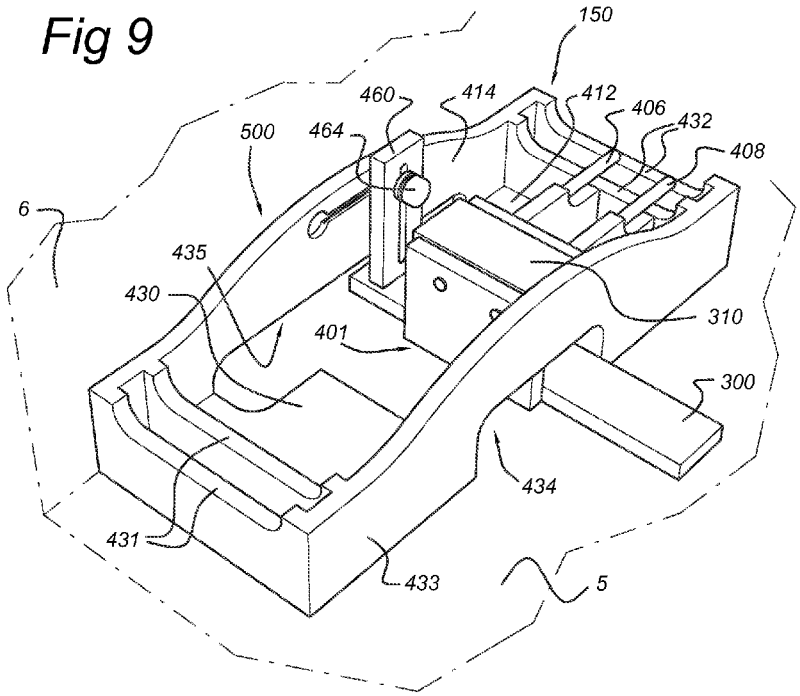
FIG. 9 shows a perspective view of a holding device in accordance with another embodiment of the present invention, in a horizontal mode of operation.

In this exemplary embodiment, the clamping arrangement is assembled from a plurality of parts, for instance a vise plate 402, a vise clamp plate 404 and two steel rods 406, 408, wherein the plates 402,404 in combination with the steel rods 406 form a vise for fixedly clamping a work piece 300 relative to the guiding arrangement 500. The guiding arrangement 500 comprises a base plate 412 attached to the vise plate 402, a fence 414 attached to the base plate 412, and a number of further structural elements for providing the guiding arrangement with sufficient structural strength and integrity. The further structural elements may comprise a further support plate 430 that may be placed on the router table (not shown in the figures) when the device is used in a horizontal mode of operation, side walls 431, 432 and a front wall 433. The bottom portion of the front wall 433 has a clearance or recess 434 extending that is shaped to allow a work piece 300 to pass the front wall, as is shown in FIG. 9. Furthermore the width of the recess 434 is larger than the maximum width of the work piece so that the device can cope with work pieces of different size and/or shape. Similarly, the back wall or fence 414 is provided with a recess 435 to be able to accommodate different sized work pieces 300.

The guiding arrangement 500 further comprises a hold-down piece 460 and a clamping knob 464. The hold-down piece 460 is slideably arranged so that it may be moved upward or downward in order to be able to position the lower edge of the hold-down piece exactly on top of the work piece 300 and/or so that it may be moved in lateral direction in order to be able to position the lower edge of the hold-down piece 46 at a substantially centered location relative to the work piece 300. For instance, if the work piece 300 shown in FIG. 9 is replaced by a larger work piece (having a larger width), the hold-down piece 460 is to be moved laterally to the left in order to keep the hold-down piece 460 centralised relative to the work piece.

In this embodiment a large part of the elements forming the clamping arrangement 401 and the guiding arrangement 500 are essentially permanently connected to one another or even integrated (for instance formed from one piece of injection moulded plastic or a similar material). In certain embodiments of the invention the holding device 150 is made of melamine surfaced MDF, plywood or plastic (e.g. glass reinforced Nylon) parts, with steel rods, or extruded aluminium.

As mentioned earlier in connection with the first embodiment of the present invention, the clamping arrangement 401 comprises a first clamping element (for instance the vise plate 402) and a second clamping element (for instance the vice clamp plate 404), that may be moved relative to one another.

In a further embodiment (not shown in the figures) an additional steel rod is arranged between the vise plate 402 and vise clamp plate 404, preferably at a position close to the centre of the plates. This additional steel rod is configured so as to exercise a clamping force between the vise plate 402 and the vise clamp plate 404 for holding a work piece 300 and an auxiliary piece 310. To this end the additional rod be threaded. Using one or more bolts the vise clamp plate 404 can be bolted such that the work piece 300 is clampingly held between the vise clamp plate 404 and vise plate 402.

In other embodiments, however, the vise plate 402 and the vise clamp plate 404 are arranged to cooperate with an external clamp, such as the hand clamp 400 shown in FIG. 5. In these embodiments the external clamp provides the clamping force in between the vise plate 402 and the vise clamp plate 404 for holding the work piece 300 and the auxiliary piece 310. The clamp comprises two outer ends that may be placed against the sides of the vise plate 402 and vise clamp plate 404. The clamp is configured to have the outer ends exert an inward force on the plates 402,404 in order to clamp the work piece 300 and the auxiliary piece 310 between the plates 402,404. In a preferred embodiment the outer ends are positioned to engage on the plates 402,404 at a location between the lower work piece 300 and the upper auxiliary piece 310 or, even more preferably, exactly halfway between the lower work piece 300 and the upper auxiliary piece 310. In the shown embodiment this means that the clamp ends engage the plates 402,404 at their respective centres. This location of the ends of the clamp provides for an essentially even distribution of the clamping forces and therefore reduces the occurrence of unwanted stress in the remainder of the clamping arrangement and in the guiding arrangement.

Figure 10:
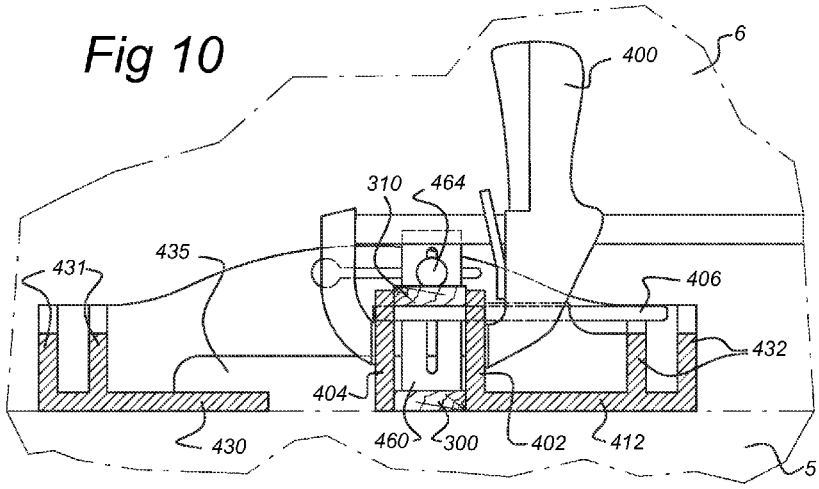
FIG. 10 shows a longitudinal cross-section of the holding device of FIG. 9.
Figure 11:
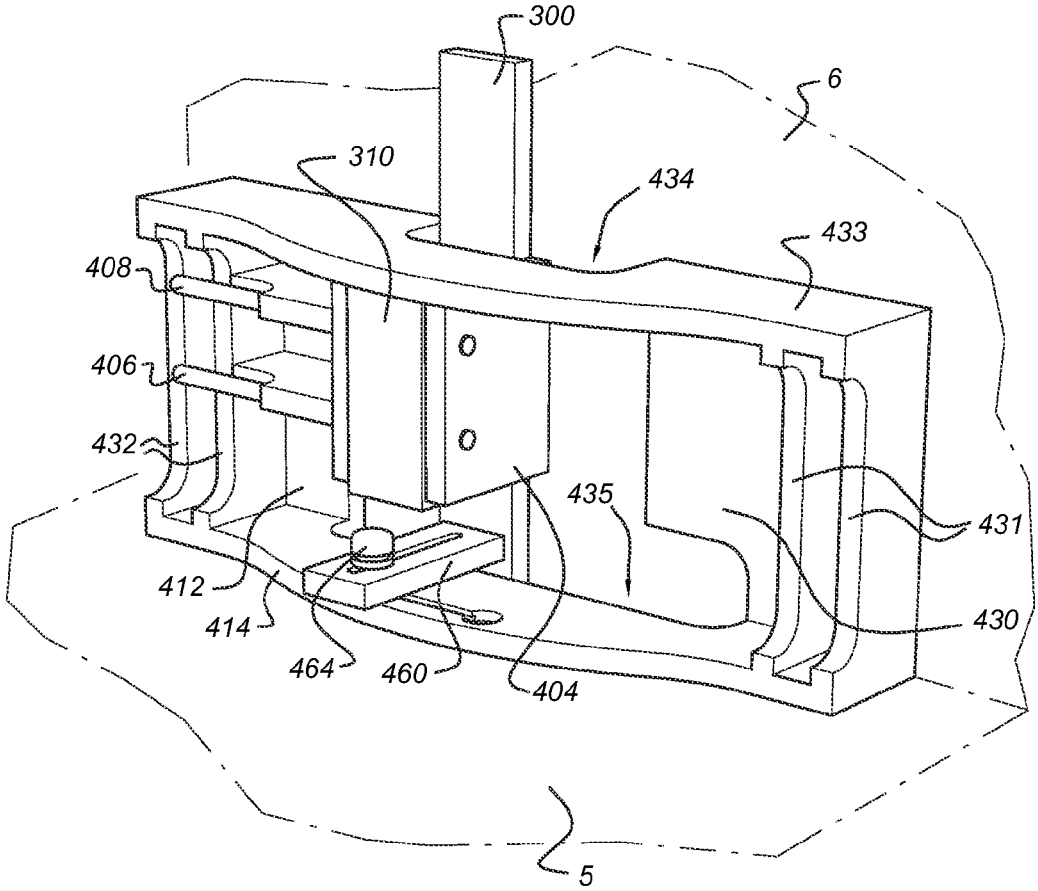
FIG. 11 shows a perspective view of the embodiment of the holding device of FIGS. 9 and 10.

Referring to FIGS. 9 and 10, for horizontal operation, the base plate 412 rests on the router table 5, whereas the fence 414 extends essentially perpendicular to the router table surface and guides with its outer surface along the router fence 6. Referring to FIG. 11, for vertical operation, the fence 414 rests on the router table 5 and the base plate 412 extends essentially perpendicular to the router table surface and guides with its outer surface along the router fence 6.

One of the advantages of the embodiments of FIGS. 8-11 is that no disassembling and reassembling is needed whenever the mode of operation changes between the vertical mode of operation and the horizontal mode of operation. Furthermore, these embodiments enable a more efficient manufacturing process of the system and are relatively easy to use.

In a further embodiment the first and second clamping elements are arranged to be moveable relative to one another, wherein an external clamp engages on the first and second clamping element and applies a force on the first and second element causing the first and second element to be urged towards each other. This has the effect that a work piece arranged between the first and second clamping element can be clampingly held by the holding device. In a further embodiment the clamp engages the holding device only on the outer surfaces of the first and second clamping element. Because the clamp only engages on the clamping elements and no further connection or engagement with other parts of the holding device are present, deformations in the holding device as a result of the stress caused by the clamping force can be avoided or at least reduced. This may improve the accuracy of the routing process.

Although the invention has been described with reference to specific embodiments thereof, it will be appreciated that invention is not limited to these embodiments and that changes and modifications to the system and method described herein may be made without departing from the invention. The rights applied for are defined by the following claims.

The invention claimed is:

1. A system for machining a work piece having an end face disposed at right angles to a pair of elongate side surfaces, the system comprising:

a router device arranged and constructed for routing out the end face of the work piece with a router bit, a holding device arranged and constructed to hold the work piece while being routed, the router device comprising a first reference element for providing a first guidance reference and a second reference element positioned substantially perpendicular to the first reference element for providing a second guidance reference, both reference elements being arranged to guide the holding device in a lateral direction during machining of the work piece by securing the second reference element to the first reference element in a corresponding position, wherein one of the first reference element and the second reference element is a router table for supporting the work piece, and the other of the first reference element and the second reference element is a router fence, the holding device comprising a clamping arrangement and a guiding arrangement, the guiding arrangement comprising a first guiding element in the form of a base plate and a second guiding element in the form of a fence substantially perpendicular to the first guiding element for guiding the holding device along the first guidance reference and the second reference element, the clamping arrangement being arranged for clamping the work piece with a clamping force being exercised substantially in the lateral direction, and wherein the clamping arrangement includes a first clamping element and a second clamping element disposed parallel to each other, and the first and second clamping elements are adapted to engage the side surfaces of the work piece and retain the work piece therebetween.

2. The system according to claim 1, wherein the clamping arrangement is arranged for positioning the work piece substantially in line with at least one of the first guiding element and the second guiding element.

3. The system according to claim 1, wherein the guiding arrangement is substantially free of the clamping force.

4. The system according to claim 1, wherein the clamping arrangement and the guiding arrangement are an integrally formed part.

5. The system according to claim 1, wherein the clamping arrangement is arranged to further hold an auxiliary piece between the first clamping element and the second clamping element, the auxiliary piece having substantially the same width as a width of the work piece.

6. The system according to claim 5, wherein, during holding the work piece and the auxiliary piece, the clamping force is substantially evenly distributed over the work piece and the auxiliary piece.

7. The system according to claim 5, wherein, during holding the work piece and the auxiliary piece, a substantially rectangular box is formed by the work piece, the auxiliary piece, the first clamping element and the second clamping element.

8. The system according to claim 5, wherein the clamping force is applied to positions on the first clamping element and the second clamping element in between the work piece and the auxiliary piece.

9. The system as claimed in claim 8, wherein the clamping force is applied essentially halfway between the position of the work piece and auxiliary piece.

10. The system according to claim 1, wherein the clamping arrangement further comprises an orientation device between the first clamping element and the second clamping element, the orientation device being arranged for maintaining a relative orientation between the first clamping element and the second clamping element.

11. The system according to claim 10, wherein the orientation device is further arranged for providing at least part of the clamping force between the first clamping element and the second clamping element.

12. The system according to claim 1, wherein the holding device is arranged for, in a first condition, holding the work piece for machining the work piece in a first orientation wherein the first guidance element is guided along the first reference element and the second guidance element is guided along the second reference element, and, in a second condition, holding the work piece for machining the work piece in a second orientation wherein the first guidance element is guided along the second reference element and the second guidance element is guided along the first reference element.

13. The system according to claim 1, wherein the second guidance element comprises a fixation element, being a hold down plate with hold down end piece, for adjustably fixating the work piece in position in the holding device; and wherein the hold down plate is adjustably secured to the first guiding element and is movable to contact the work piece.

14. The system according to claim 1, wherein the guiding arrangement comprises a clearance for allowing an unobstructed machining of the work piece with the router bit.

15. The system according to claim 1, wherein the router further comprises a router collet positioned beneath the router table, the router collet is constructed and arranged to engage the router bit extending through an opening in the router table for machining the work piece.

16. The system according to claim 15, wherein the router collet is further constructed and arranged for machining the work piece with the router bit through an opening in the router fence.

17. The system according to claim 1, further comprising an external clamp, and wherein the clamping arrangement is arranged for cooperating with the external clamp providing at least part of the clamping force between the first clamping element and the second clamping element.

18. The system as claimed in claim 17, wherein the external clamp is configured so as to engage on the first and second clamping element and to apply a force to the first and second clamping element causing the first and second clamping element to be urged towards each other.

19. The system as claimed in claim 18, wherein the external clamp engages the holding device only on the outer surfaces of the first and second clamping element.

20. A holding device for holding a work piece for being routed using a router device with a router bit, the router device comprising a first reference element for providing a first guidance reference and a second reference element positioned substantially perpendicular to the first reference element for providing a second guidance reference, wherein one of the first reference element and the second reference element is a router table for supporting the work piece, and the other of the first reference element and the second reference element is a router fence; the reference elements being arranged to guide the holding device in a lateral direction during machining of the work piece by securing the second reference element to the first reference element in a corresponding position, the holding device comprising a clamping arrangement and a guiding arrangement, the guiding arrangement comprising a first guiding element in the form of a base plate and a second guiding element in the form of a fence substantially perpendicular to the first guiding element for guiding the holding device along the first guidance reference and the second reference element, wherein the clamping arrangement includes a first clamping element and a second clamping element disposed parallel to each other, and the first and second clamping elements are adapted to engage the side surfaces of the work piece and retain the work piece therebetween; and the clamping arrangement being arranged for clamping the work piece with a clamping force being exercised substantially in the lateral direction.

21. The holding device according to claim 20, wherein the clamping arrangement is further arranged for positioning the work piece substantially in line with at least one of the first guiding element and the second guiding element.

22. The holding device according to claim 20, wherein the clamping arrangement and the guiding arrangement are an integrally formed part.

23. The holding device according to claim 20, wherein the clamping arrangement is arranged to further hold an auxiliary piece between the first clamping element and the second clamping element, the auxiliary piece having substantially the same width as a width of the work piece.

24. The holding device according to claim 23, wherein, during holding the work piece and the auxiliary work piece, the clamping force is substantially evenly distributed over the work piece and the auxiliary work piece.

25. The holding device according to claim 23, wherein, during holding the work piece and the auxiliary piece, a substantially rectangular box is formed by the work piece, the auxiliary piece, the first clamping element and the second clamping element.

26. The holding device according to claim 24, wherein the clamping force is applied to positions on the first clamping element and the second clamping element in between the work piece and the auxiliary piece.

27. The holding device according to claim 24, wherein the clamping arrangement further comprises an orientation device between the first clamping element and the second clamping element, the orientation device being arranged for maintaining a relative orientation between the first clamping element and the second clamping element.

28. The holding device according to claim 27, wherein the orientation device is further arranged for providing at least part of the clamping force between the first clamping element and the second clamping element.

29. The holding device according to claim 20, further comprising an external clamp, and wherein the clamping arrangement is arranged for cooperating with the external clamp providing at least part of the clamping force between the first clamping element and the second clamping element.

30. The holding device according to claim 20, wherein the holding device is arranged for, in a first condition, holding the work piece for machining the work piece in a first orientation wherein the first guidance element is guided along the first reference element and the second guidance element is guided along the second reference element, and, in a second condition, holding the work piece for machining the work piece in a second orientation wherein the first guidance element is guided along the second reference element and the second guidance element is guided along the first reference element.

31. A method for routing a work piece using a router device comprising a first reference element for providing a first guidance reference and a second reference element positioned substantially perpendicular to the first reference element for providing a second guidance reference, wherein one of the first reference element and the second reference element is a router table for supporting the work piece, and the other of the first reference element and the second reference element is a router fence; the reference elements being arranged to guide the holding device in a lateral direction during machining of the work piece by securing the second reference element to the first reference element in a corresponding position, the holding device comprising a clamping arrangement and a guiding arrangement, the guiding arrangement comprising a first guiding element in the form of a base plate and a second guiding element in the form of a fence substantially perpendicular to the first guiding element for guiding the holding device along the first guidance reference and the second reference element, and the clamping arrangement being arranged for clamping the work piece with a clamping force being exercised substantially in the lateral direction, the method comprising:

clamping the work piece with the force being exercised substantially in the lateral direction in the clamping arrangement in the holding device and so that an end face of the work piece is substantially flush with a region of one of the first guidance reference and the second guiding reference that will ride along the router fence, guiding the holding device holding the work piece along the first guidance reference and the second guiding reference, and machining the end face of the work piece with a router bit extending outwardly from the router table while the holding device is guided.

32. The method as claimed in claim 31, comprising:

positioning the work piece between the clamping elements of the clamping arrangement;

positioning an auxiliary piece between the clamping elements of the clamping arrangement;

clamping both the auxiliary piece and the work piece between the clamping elements.

33. The method as claimed in claim 32, wherein the work piece is positioned close to a first edge of each clamping element and the auxiliary piece is positioned close to a second, opposite edge of each clamping element.

34. The method according to claim 32, wherein the method further comprises:

holding the auxiliary piece having a substantially same width as a width of the work piece in parallel to the work piece while clamping the work piece in the clamping arrangement.

35. The method according to claim 32, comprising:

first, holding the work piece for machining the work piece in a first orientation, guiding the first guidance element along the first reference element and the second guidance element along the second reference element, while the holding device is in a first condition, and subsequently, holding the work piece for machining the work piece in a second orientation wherein the first guidance element is guided along the second reference element and the second guidance element is guided along the first reference element, while the holding device is in a second condition.

36. The system as defined in claim 1, wherein the guiding arrangement further comprises:

a first aperture defined in the base plate, where the first aperture originates at a first side of the base plate where the base plate joins the fence, and the first aperture extends for a distance inwardly toward an opposed second side of the base plate;

a second aperture defined in the fence, wherein the second aperture originates at a bottom end of the fence where the fence joins the base plate and continues for a distance upwardly toward an opposed top end of the fence; and wherein the first and second apertures are in communication with each other; and wherein the holding device is positioned so as to retain the end face of the work piece the region of the first second apertures that is generally aligned with the first side of the base plate where the base plate joins the fence.

37. The system as defined in claim 1, wherein the first and second clamping elements have first and second ends, and the first ends of the first and second elements are spaced a first distance inwardly away from the base plate and the second ends of the first and second elements are spaced a second distance away from the base plate, where the second distance is greater than the first distance, and wherein the first and second clamping elements are adapted to retain the work piece so that a portion thereof extends beyond the first ends of the first and second clamping elements and the end face to be routed is held substantially flush with the base plate.

38. The system as defined in claim 13, wherein the first guiding element defines one of a vertical and a horizontal slot, and the hold down plate defines the other of a vertical and a horizontal slot; and wherein the system further includes a fastener element which extends through the slots of the hold down plate and the first guiding element, and the fastener element is loosened to permit vertical and horizontal adjustment in the position of the hold down plate on the first guiding element, and the fastener element is secured to lock the hold down plate in the adjusted position on the first guiding element.

39. The system as defined in claim 38, wherein the hold down plate is raised to permit insertion or removal of the work piece from the clamping apparatus; and the hold down plate is lowered to engage the hold down end piece on an upper surface of the work piece to maintain the end face of the work piece in position to be routed out.

40. The holding device as defined in claim 20, wherein the guiding arrangement further comprises:

a first aperture defined in the base plate, where the first aperture originates at a first side of the base plate where the base plate joins the fence, and the first aperture extends for a distance inwardly toward an opposed second side of the base plate;

a second aperture defined in the fence, wherein the second aperture originates at a bottom end of the fence where the fence joins the base plate and continues for a distance upwardly toward an opposed top end of the fence; and wherein the first and second apertures are in communication with each other; and wherein the holding device is positioned so as to retain the end face of the work piece the region of the first second apertures that is generally aligned with the first side of the base plate where the base plate joins the fence.

41. The holding device as defined in claim 20, wherein the first guiding element defines one of a vertical and a horizontal slot, and the hold down plate defines the other of a vertical and a horizontal slot; and wherein the system further includes a fastener element which extends through the slots of the hold down plate and the first guiding element, and the fastener element is loosened to permit vertical and horizontal adjustment in the position of the hold down plate on the first guiding element, and the fastener element is secured to lock the hold down plate in the adjusted position on the first guiding element.

42. The holding device as defined in claim 20, wherein the first and second clamping elements have first and second ends, and the first ends of the first and second elements are spaced a first distance inwardly away from the base plate and the second ends of the first and second elements are spaced a second distance away from the base plate, where the second distance is greater than the first distance, and wherein the first and second clamping elements are adapted to retain the work piece so that a portion thereof extends beyond the first ends of the first and second clamping elements and the end face to be routed is held substantially flush with the base plate.

* * * * *